US006186643B1

(12) United States Patent
Ewing

(10) Patent No.: US 6,186,643 B1
(45) Date of Patent: Feb. 13, 2001

(54) MODULAR ELECTRICAL ASSEMBLY FOR ORNAMENTAL LUMINAIRE

(75) Inventor: Robert Lowell Ewing, Licking, OH (US)

(73) Assignee: NSI Enterprises, Inc., Newark, OH (US)

( * ) Notice: Under 35 U.S.C. 154(b), the term of this patent shall be extended for 0 days.

(21) Appl. No.: 09/326,372

(22) Filed: Jun. 4, 1999

(51) Int. Cl.[7] ..... H01R 33/00

(52) U.S. Cl. ..... 362/226; 362/226; 362/21; 362/375; 362/374

(58) Field of Search ..... 362/226, 21, 375, 362/374, 395, 394; 315/185 R, 185 S

(56) References Cited

U.S. PATENT DOCUMENTS

| | | | |
|---|---|---|---|
| 3,071,683 | 1/1963 | Queale | 362/295 |
| 3,297,864 | 1/1967 | Waldbauer | 362/310 |
| 4,414,615 | 11/1983 | Szeker et al. | 362/264 |
| 4,937,718 | 6/1990 | Murray | 362/431 |
| 5,136,493 | 8/1992 | Straus et al. | 362/373 |
| 5,243,508 | 9/1993 | Ewing et al. | 362/431 |
| 5,351,174 | 9/1994 | Ewing | 362/226 |
| 5,918,970 * | 7/1999 | Brohard et al. | 362/370 |

FOREIGN PATENT DOCUMENTS 1508-211 4/1978 (GB) .

* cited by examiner

*Primary Examiner*—Alan Cariaso
*Assistant Examiner*—Ronald E. DelGizzi
(74) *Attorney, Agent, or Firm*—Paul M. Schwartz

(57) ABSTRACT

A modular ornamental luminaire assembly including a luminaire electrical chamber, an ornate cover, and an electrical assembly which is easily affixable or removable from the ornate cover. The luminaire electrical chamber houses an electrical terminal block and an electrical disconnect. The luminaire electrical chamber further includes at least one hollow support arm for supporting the luminaire's optical unit in spatial relation to the electrical components. The hollow support arm maintains and protects the electrical connection between the optical unit and electrical assembly. The electrical assembly is easily affixable to the underside of the cover and easily removable with the cover from the luminaire electrical chamber when the cover is removed from the chamber. The electrical assembly is removed by disconnecting the electrical assembly from the electrical disconnect.

10 Claims, 3 Drawing Sheets

Fig. 2
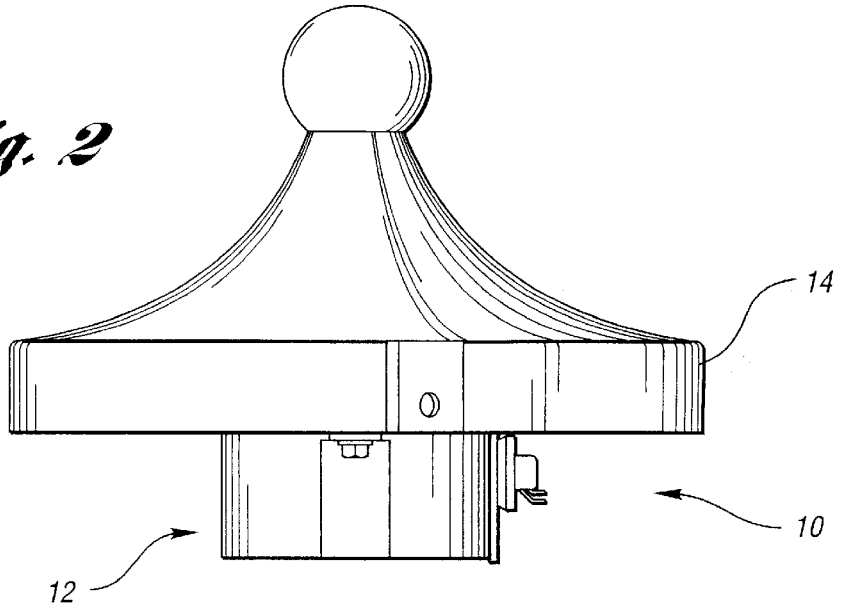
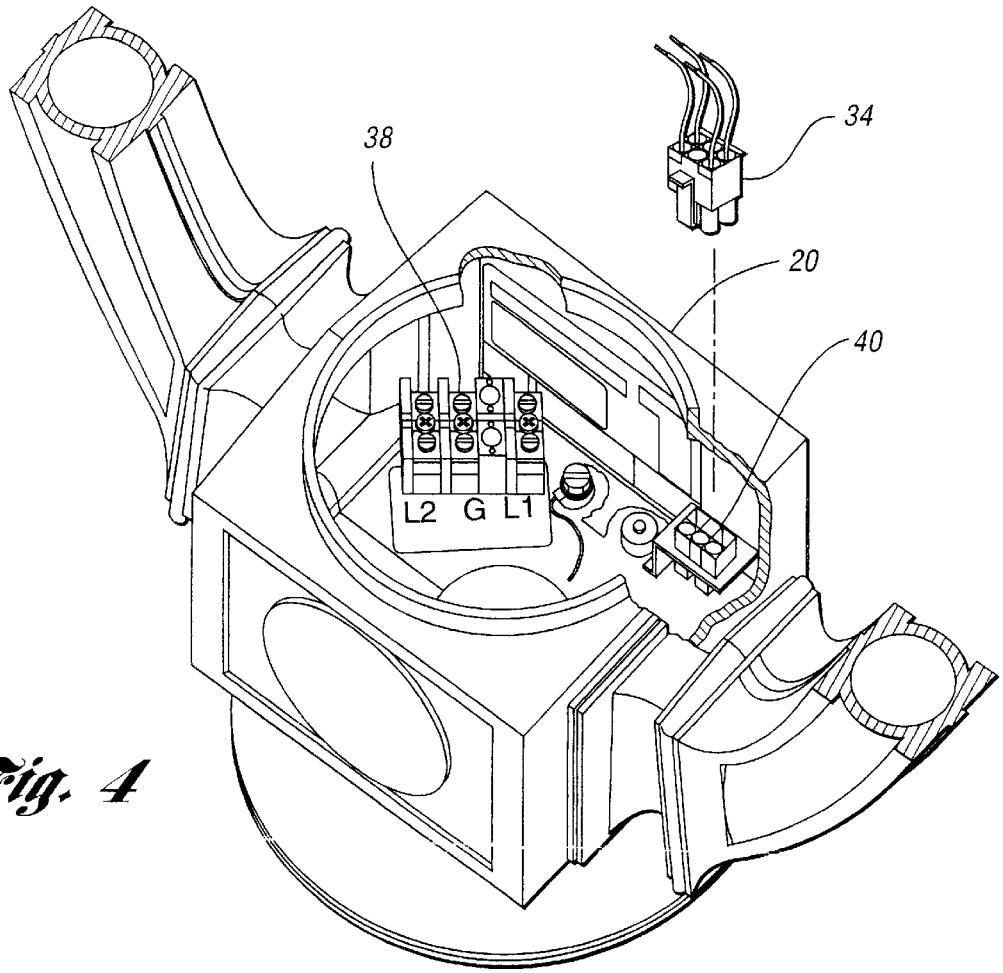
Fig. 4

MODULAR ELECTRICAL ASSEMBLY FOR ORNAMENTAL LUMINAIRE

TECHNICAL FIELD

This invention relates to a modular luminaire assembly having electrical components easily accessible in a covered chamber for maintenance.

BACKGROUND ART

Luminaire assemblies include a housing for enclosing and protecting electrical components required for operation of the luminaire. The optical assembly is generally comprised of a lighting unit and a refractor for producing and directing light of various intensities. These prior art designs often utilize electrical assemblies that are wired directly to the lighting unit through the use of a plurality of wires, splicing means, permanent connecting means, and the like.

Direct wired electrical assemblies have been used to ensure proper electrical contact between system components. Designs have resulted in increased installation and maintenance costs because of the minimal flexibility afforded by the mechanical design. For example, particular system components of traditional luminaire assemblies may require repair, replacement and adjustment. In high pressure sodium systems, for example, starters, ballasts and capacitors require routine maintenance. Similarly, the wattage characteristics, voltage characteristics or both may require adjustment to provide the proper amount of illumination and to conserve energy. These maintenance procedures include the disassembly of sometimes heavy and awkward parts as well as the removal, splicing and reconnection of electrical wires. Because of the direct wired design of previous systems, these maintenance procedures must also be performed on site or, the luminaire must be temporarily disabled while the particular component is repaired in the laboratory or factory.

The optical units of the prior art luminaire assemblies are also known to require routine repair, replacement and maintenance. For example, it is known that refractors and lighting units often must be replaced when the surfaces are penetrated by foreign substances or when they have been fractured as a result of weather conditions or tampering. These time-consuming and labor intensive maintenance procedures must be performed on-site and on a regular basis.

The maintenance procedures referenced above are, of course, further hindered during adverse weather conditions including heavy winds, rain and snow as well as extreme temperature gradients. The maintenance complications inherent in the prior art luminaire assembly designs have resulted in increased labor and maintenance costs which, in turn, have caused purchasers and luminaire designers to turn their attention toward viable design alternatives.

In addition to hindering repair and replacement of components, luminaire assemblies of the prior art suffer from a lack of flexibility in design. These designs make insufficient use of subassemblies, though it is well known that flexibility increases with proper employment of subassemblies. For example, instead of individually mounting small components such as starters, ballasts and capacitors to a lighting unit, it may be possible to instead attach them to a base or platform. This platform would comprise a subassembly which is then mounted to the lighting unit. Modified or new electrical components may then be incorporated into the platform. The platform can be modified to accept the new component inexpensively and quickly without affecting any other part of the luminaire. Creation of the most efficient number and type of subassemblies which allow for flexibility in design is an important object of current designers for ornamental luminaires.

U.S. Pat. Nos. 5,351,174 issued Sep. 27, 1994 to Ewing; 5,243,508 issued Sep. 7, 1993 to Ewing et al. and 3,071,683 issued to Queale; Ewing et al., and Queale, respectively, disclose prior art luminaire designs of the type referenced above. The '174 patent discloses a modular luminaire assembly which includes a top mounted ballast housing and a depending glass refractor or optical unit. The optical unit is removably affixable to the underside of the top mounted housing and an electrical assembly is removably affixable to the upper side of the top mounted housing. However, a cover plate must first be removed to access the electrical components. A hinged cover closes the housing after the electrical assembly is inside the housing.

The '508 patent discloses a modular luminaire assembly for receiving assorted optical assemblies and assorted electrical assemblies in a base housing. A removable panel closes an opening in the base housing and is replaceable along with the electrical assembly supported thereon. The modular design of the '508 patent requires the housing enclosing the electrical subassembly to be directly affixed to the optical assembly and requires the user to replace the cover panel whenever the electrical components are replaced.

The '683 patent discloses a luminaire having a lighting unit, a refractor, and an electrical assembly wherein the luminaire is pivotably affixed to the luminaire housing at one end. The electrical components are directly wired to the lighting unit and thus require maintenance on-site.

What is needed is a modular electrical assembly for an ornamental luminaire which allows for flexibility in design and where the system components may be readily repaired, replaced and adjusted.

DISCLOSURE OF INVENTION

According to the present invention, a modular electrical assembly is provided which provides for flexibility in designing an ornamental luminaire and permits system components of the ornamental luminaire to be readily repaired, replaced, and adjusted on site. These advantages are achieved by electrically connecting the optical unit and the electrical components through a quick disconnect and by simplifying the modular arrangement. An easily accessible and replaceable plate is used in conjunction with an electrical assembly where all components are wired together and those components terminate with a quick disconnect connector. The components are removably affixed to the inside of the ornate cover.

In accordance with the modular design, an ornate casting cover is mounted on one side of the electrical assembly. The plate is easily attachable to and removable from the ornate casting cover and has keyhole slots in the plate for securing the electrical subassembly inside the ornate casting cover. The electrical components are wired together on the plate pursuant to known circuit configurations. A quick disconnect connector is attached to the modular electrical assembly. This modular design results in reduced service and maintenance time given that the configuration provides for easier access to the electrical components. Furthermore, no hard wiring or splicing is required.

The present invention allows a user to quickly and efficiently replace electrical components. The ornate casting cover is removably affixable to the ornamental luminaire by simply unfastening the cover from the luminaire electrical chamber. As the cover is lifted from the electrical chamber, the electrical components are also removed as the electrical assembly is mounted on a plate easily affixed to the underside of the ornate cover. The mounting plate and the electrical components may be easily removed from the luminaire by merely removing the quick disconnect and twisting the plate off of the cover.

In addition to promoting the efficient replacement of components, the present invention also allows for flexibility in designing an ornamental luminaire. Unlike prior art designs, the present invention does not require electrical components such as the ballast and capacitor to be directly joined to the optical unit. The optical unit is generally comprised of a lighting unit and a refractor for directing light of various intensities. Accordingly, ornate luminaires may be designed with a variety of configurations placing the electrical components in a separate chamber from the optical unit, and utilizing structures such as support arms to house the electrical wires between the optical unit and electrical components.

Accordingly, it is the principal object of the present invention to provide a modular luminaire electrical assembly wherein the system components may be readily repaired, replaced, and adjusted by easily mounting and removing the electrical subassembly from the inside of the ornate casting cover and attaching a quick disconnect.

In carrying out the above objects, the modular luminaire assembly, adapted for electrical connection to a lamp socket, includes a luminaire electrical chamber for housing an electrical terminal block, and an electrical disconnect. The electrical disconnect is accessible through an opening in the chamber and is in electrical contact with the terminal block. The modular luminaire assembly further includes a cover which is removably affixable to the chamber for closing the opening in the chamber. The electrical assembly is removably affixable to the cover from the chamber. The electrical assembly includes a quick disconnect which is accessible when the cover is removed from the chamber.

These and other objects, features, and advantages will be readily apparent upon consideration of the following detailed description of the invention in conjunction with the accompanying drawings.

BRIEF DESCRIPTION OF DRAWINGS

FIG. 2 is a side elevational view of the cover-mounted electrical assembly in the modular luminaire of the present invention;

FIG. 4 is a perspective view of the luminaire electrical chamber onto which the cover mounted modular electrical assembly is mounted.

BEST MODE FOR CARRYING OUT THE INVENTION

Figure 1:
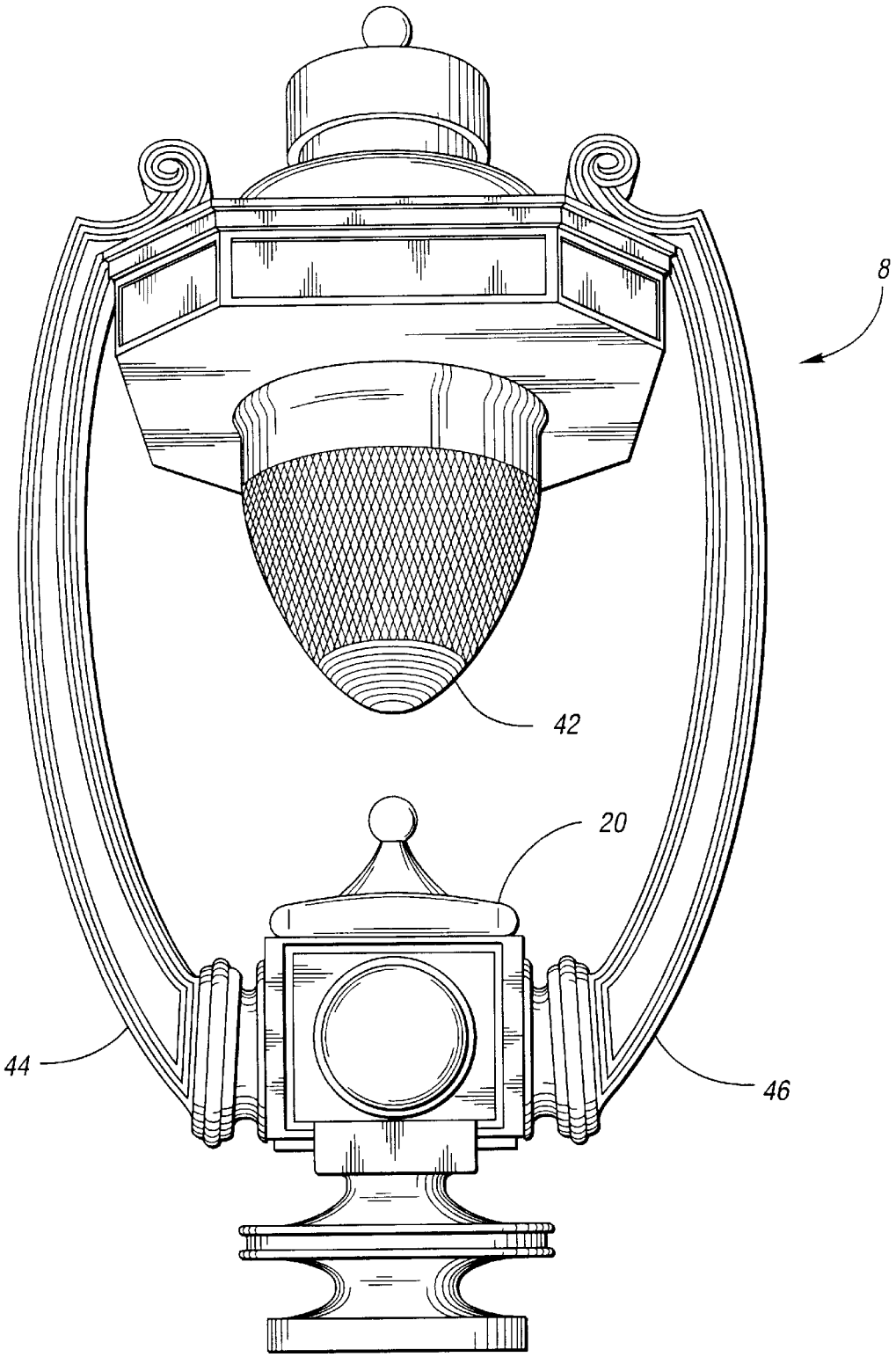
FIG. 1 is a front perspective view of the modular ornamental luminaire.

Referring first to FIG. 1, the entire ornamental luminaire 8 is illustrated. In accordance with the goal to allow for flexible designs, the ornamental luminaire 8 is configured to mount the electrical luminaire chamber 20 and the optical unit 42 separately. Hollow support arms 44, 46 affixed to each side of the luminaire electrical chamber 20 support the optical unit 42 and also house wiring necessary to support the electrical connection between the optical unit 42 and the components in the electrical chamber 20.

Referring next to FIG. 2, the apparatus of the present invention for a modular luminaire electrical assembly is generally indicated by reference numeral 10. As seen therein, the electrical components 12 are disposed within an ornate casting cover 14 to protect and support the electrical components 12.

Figure 3:
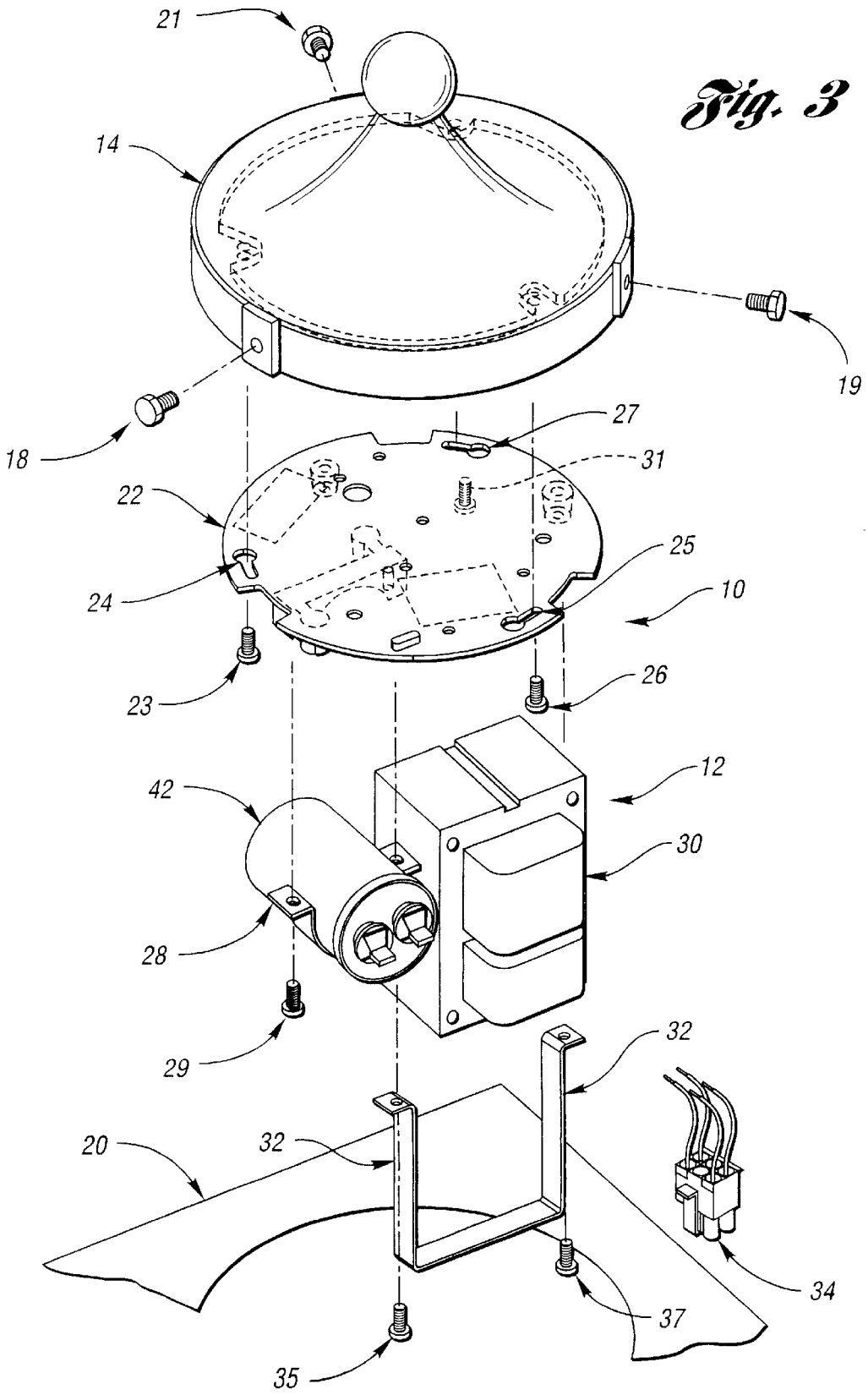
FIG. 3 is an exploded perspective view of the cover-mounted electrical assembly in the modular luminaire of the present invention.

Referring next to FIG. 3, an exploded perspective view of a modular electrical assembly 10 is shown. As seen in FIG. 3, an ornate casting cover 14 has three attachment screws 18, 19, 21 for mounting modular electrical assembly 10 to the luminaire's chamber 20. An electrical components plate 22 is attached to the ornate casting cover 14 with screws 23, 26, 31 through three keyhole slots 24, 25, 27 into the casting cover 14. Capacitor 42 is attached to component plate 22 with capacitor strap 28 and two screws 29, 35. Ballast 30 is attached to component plate 22 with ballast strap 32 and two screws 35, 37. One screw 35 is used for both capacitor strap 28 and ballast strap 32. After all the necessary wire connections have been made, electrical components 12 are bundled and attached to quick disconnect 34.

With reference to FIG. 4, luminaire electrical chamber 36 is illustrated. Inside electrical chamber 20 is terminal block 38 to which the user attaches a supply wire. Also shown inside electrical chamber 36 is electrical disconnect 40 into which disconnect 34 on modular electrical subassembly 10 is plugged. As a result of the foregoing configuration, the modular design of the luminaire electrical assembly 10 of the present invention results in reduced service and maintenance time given that the electrical components 12 are easily accessible and no hard wiring or splicing is required.

While the invention has been particularly shown and described in reference to the preferred embodiment thereof, it will be understood by those skilled in the art that various changes in form and detail may be made therein without departing from the spirit and scope of the invention.

What is claimed is:

1. A modular luminaire assembly comprising:

a luminaire electrical chamber having a top opening and a hollow arm adapted to support an optical unit above the chamber, the chamber housing an electrical terminal block adapted to receive a power supply wire and an electrical disconnect, the electrical disconnect accessible through the top opening in the chamber and electrically connected with the terminal block in the chamber and adapted to be electrically connected with the optical unit through the hollow arm;

an ornate cover removably affixable to the chamber for closing the top opening in the chamber;

an electrical assembly easily affixable to the underside of the cover and easily removable with the cover from the chamber when the cover is removed from the chamber; and the electrical assembly, including a quick disconnect electrically connectable to the electrical disconnect and accessible when the cover is removed from the chamber for disconnecting the electrical assembly from the electrical disconnect to facilitate the replacement of the electrical assembly on the ornate cover or maintenance of the electrical assembly on the ornate cover.

2. The modular luminaire assembly of claim 1 further comprising an optical unit mounted on the hollow arm separate from the electrical assembly and above the cover, the optical unit being electrically connected to the electrical disconnect through the hollow arm, the optical unit being operative to diffuse light from the modular luminaire.

3. The modular luminaire assembly of claim 1 wherein the electrical assembly includes electrical components on which the electrical maintenance is done and further comprises:

a mounting plate for removably affixing the electrical assembly to the cover, and wherein the mounting plate supports the electrical components including a ballast and a ballast strap for removably affixing the ballast to the mounting plate, a capacitor and a capacitor strap for removably affixing the capacitor to the mounting plate; and at least one fastener for mounting the electrical components to the mounting plate.

4. The modular luminaire assembly of claim 3 wherein the underside of the cover has a fastener and the mounting plate has a planar surface and at least one key-hole shaped aperture defined therein in rotatably affixing relationship with the fastener on the cover.

5. A modular ornamental luminaire assembly for operatively receiving assorted electrical assemblies, the luminaire assembly comprising:

a luminaire electrical chamber having an opening and a hollow arm and including an electrical terminal block adapted to receive a power supply wire and an electrical disconnect, the electrical disconnect accessible through the opening in the chamber and electrically connected with the terminal block;

an ornate casting cover removably affixable to the luminaire electrical chamber for closing the opening in the chamber;

an electrical assembly removably affixable to the cover and removable with the cover from the chamber when the cover is removed from the chamber, the electrical assembly including a quick disconnect accessible when the cover is removed from the chamber for disconnecting the electrical connection while electrical maintenance is being done; and an optical unit mounted by the hollow arm in spaced relation to the electrical chamber and the electrical assembly, the optical unit electrically connected to the electrical assembly by wires in the hollow arm, the optical unit operative to diffuse light from the ornamental luminaire.

6. The modular luminaire assembly of claim 5 wherein the electrical assembly includes electrical components on which the electrical maintenance is done and further comprises:

a mounting plate for removably affixing the electrical assembly to the cover, and wherein the mounting plate supports the electrical components including a ballast and a ballast strap for removably affixing the ballast to the mounting plate, a capacitor and a capacitor strap for removably affixing the capacitor to the mounting plate; and at least one fastener for mounting the electrical components to the mounting plate.

7. The modular luminaire assembly as in claim 5 further comprising at least one support arm integral with the luminaire electrical chamber operative to support the optical unit and to house electrical wires for electrically connecting the optical unit to the luminaire electrical chamber.

8. The modular luminaire assembly as in claim 6 wherein the ballast strap surrounds the ballast and affixes the ballast to the mounting plate with a screw at each end of the ballast strap; and the capacitor strap surrounds the capacitor and affixes the capacitor to the mounting plate with a screw at each end of the capacitor strap.

9. The modular luminaire assembly of claim 6 wherein the underside of the cover has a fastener and the mounting plate has a planar surface and at least one key-hole shaped aperture defined therein in rotatably affixing relationship with the fastener on the cover.

10. A modular ornamental luminaire assembly for operatively receiving suited electrical assemblies, the ornamental luminaire assembly comprising:

a luminaire electrical chamber for housing an electrical terminal block adapted to receive a power supply wire and an electrical disconnect, the electrical disconnect accessible through an opening through an opening in the chamber and an electrical contact with the terminal block;

an ornate casting cover removably affixable to the luminaire electrical chamber for closing the opening in the chamber;

an electrical assembly removably affixable to the cover and removable with the cover from the chamber when the cover is removed from the chamber, the electrical assembly including a quick disconnect accessible when the cover is removed from the chamber for disconnecting the electrical connection while electrical maintenance is being done;

an optical unit mounted on the hollow arm separate from the electrical assembly and above the cover, the optical unit being electrically connected to the electrical disconnect through the hollow arm, the optical unit being operative to diffuse light from the ornamental modular luminaire;

a mounting plate removably affixable to the cover, the mounting plate operative to maintain electrical components of the luminaires, the mounting plate having a planar surface and at least one key-hole aperture defined therein in rotatably affixing relationship with the fastener on the cover;

a ballast and a ballast strap for removably affixing the ballast to the mounted plate;

a capacitor and a capacitor strap for removably affixing the capacitor to the mounting plate;

at least one fastener for mounting the ballast, capacitor, ballast strap, and capacitor strap to the mounting plate; and at least one hollow support arm integral with the luminaire electrical chamber operative to support the optical unit and to house electrical wires for electrically connecting the optical unit to the luminaire electrical chamber.

* * * * *